United States Patent [19]

Cherry

[11] 4,446,400

[45] May 1, 1984

[54] GASEOUS DISPLAY PANEL WITH WEBBED ANODE

[75] Inventor: Walter L. Cherry, Winnetka, Ill.

[73] Assignee: Cherry Electrical Products Corporation, Waukegan, Ill.

[21] Appl. No.: 217,091

[22] Filed: Dec. 16, 1980

[51] Int. Cl.[3] ..... H01J 61/12; H01J 61/66

[52] U.S. Cl. ..... 313/517; 313/519

[58] Field of Search ..... 313/517, 519, 513

[56] References Cited

U.S. PATENT DOCUMENTS 3,819,975 6/1974 Kunii et al. ..... 313/517

3,849,693 11/1974 Kuchinsky et al. ..... 313/210 X 3,891,883 6/1975 Ahmed ..... 313/519 X

*Primary Examiner*—Robert Segal

*Attorney, Agent, or Firm*—Hume, Clement, Brinks, Willian & Olds, Ltd.

[57] ABSTRACT

A gaseous display panel having a base plate and a face plate is disclosed. A plurality of groups of cathode segments are disposed on the base plate, and a plurality of anodes are disposed on the face plate. Each anode has a plurality of electrically conductive web portions extending across at least one of the cathode segments, the anodes, including the web portions, being deposited onto the face plate simultaneously with the application of a conductive layer used to outline the anode.

5 Claims, 4 Drawing Figures

GASEOUS DISPLAY PANEL WITH WEBBED ANODE

BACKGROUND OF THE INVENTION

This invention relates most generally to gaseous display panels of the type characterized by a gas-containing envelope. Such display panels typically have an anode and a group of cathode segments adapted to form any of a plurality of recognizable indicia such as the numerals zero through nine. Upon application of an appropriate electrical potential to the anode, and to selected ones of the cathode segments, the gas inside the envelope ionizes causing the selected cathode segments to glow. The glowing segments take the form of a desired one of the recognizable indicia.

The prior art shows many different kinds of display panels of the type generally described. One such display panel is disclosed in U.S. Pat. No. 3,849,693. The disclosure of that patent is incorporated herein by reference for its general teachings regarding the manufacture and operation of gaseous display panels.

Unlike the gaseous display panels disclosed in the aforementioned patent, wherein the anode and cathode segments are formed of metal strips, some display panels of the prior art utilize a much different construction. In particular, the anode in some prior art display panels consists of a thin metallic surface, such as a tin oxide coating, deposited onto a surface of the gas-containing envelope. For various reasons well known in the art, including the need to provide an electrical path from the tin oxide anode coating to an appropriate anode terminal located at the periphery of the glass envelope, such panels typically utilize a reinforcing stripe of nickel or the like to outline the tin oxide surface.

Though such anode constructions have produced satisfactory results, they are relatively costly, and require separate manufacturing steps in applying the tin oxide anode coating and the nickel outline. It is therefore a primary object of this invention to provide a gaseous display panel which can be manufactured in a more expeditious manner. It is a further object of this invention to provide an improved gaseous display panel which provides satisfactory results at reduced costs. Other objects of the invention, along with related features and advantages, will be apparent hereinafter.

SUMMARY OF THE INVENTION

The objects, features and advantages of the invention are achieved in a gaseous display panel having a base plate and a face plate. A plurality of groups of cathode segmenets are disposed on the base plate and a plurality of anodes are disposed on the face plate. Each anode has a plurality of electrically conductive web portions extending across at least one of the cathode segments. The anodes, including the web portions which extend across the cathode segments, can be deposited onto the face plate simultaneously with the application of the conductive layer used to outline the anode. This eliminates the necessity of first applying a tin oxide anode coating onto the face plate, thereby achieving a substantial reduction in manufacturing costs.

BRIEF DESCRIPTION OF THE DRAWINGS

An exemplary embodiment of the invention summarized above is shown in the accompanying drawings in which.

DETAILED DESCRIPTION OF AN EXEMPLARY EMBODIMENT

Figure 1:
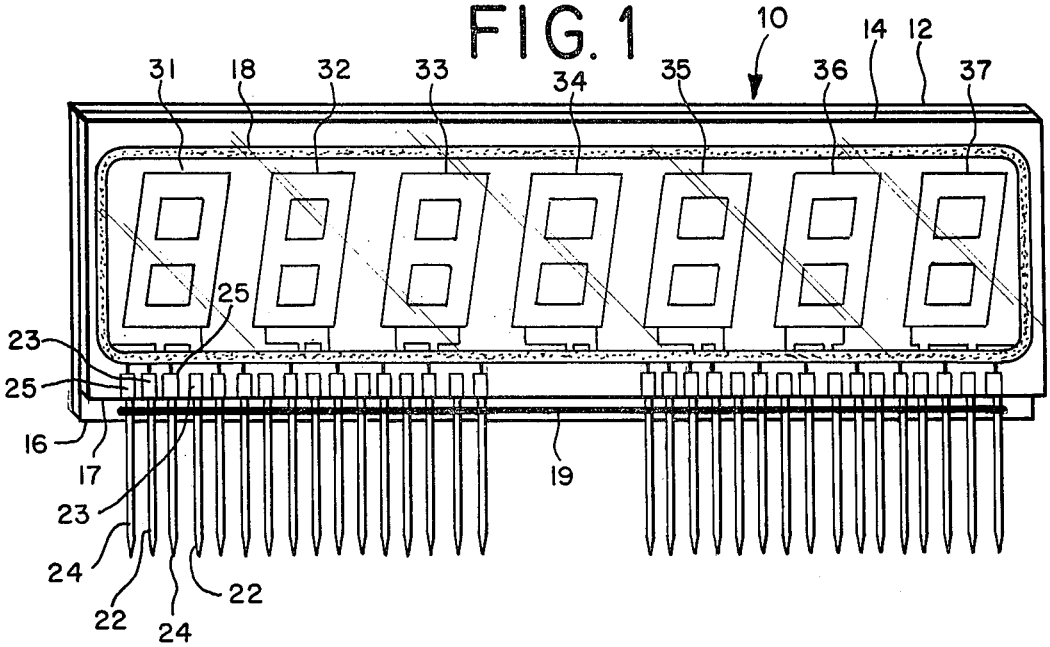
FIG. 1 illustrates a schematic rendering taken in perspective of a gaseous display panel which forms the environment of the present invention.

Referring now to FIG. 1, there is shown an exemplary gaseous display panel 10. Gaseous display panel 10 includes a base plate 12 and a face plate 14, both of which may be made of glass. Base plate 12 and face plate 14 are hermetically sealed by any appropriate sealing means 18 to form a gas-containing envelope in a manner well known in the art.

As explained in greater detail below, exemplary gaseous display panel 10 includes a plurality of display positions identified in FIG. 1 by reference numerals 31 through 37. Though seven display positions are shown in this exemplary embodiment, it should be clear that any reasonable number of positions can be provided. Indeed, in certain applications a single display position may be all that is required.

Base plate 12 and face plate 14 are substantially coextensive, except for a ledge portion 16 of base plate 12 which extends beyond the edge 17 of face plate 14. Ledge 16 supports a plurality of anode leads 22 and cathode leads 24 which extend out from under edge 17 of face plate 14. In this exemplary embodiment, a bead of adhesive material 19 secures anode leads 22 and cathode leads 24 to ledge 16 of base plate 12. As shown in FIG. 1, anode leads 22 and cathode leads 24 originate at corresponding anode terminals 23 and cathode terminals 25 which are sandwiched between base plate 12 and face plate 14 in close proximity to edge 17.

Figure 2:
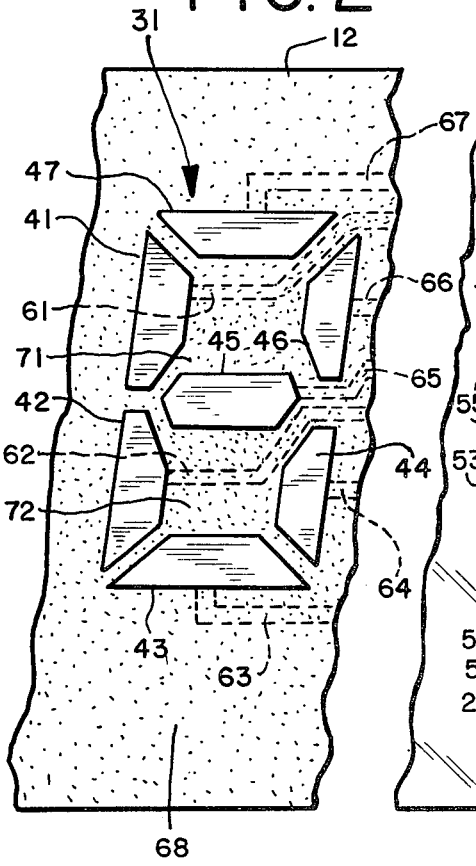
FIG. 2 illustrates a portion of the face plate of the gaseous display panel shown in FIG. 1.

A portion of base plate 12, including a typical display position 31, is shown in FIG. 2. More particularly, the top surface of base plate 12, i.e., the surface facing the lower surface of face plate 14 when the two plates are secured together as shown in FIG. 1, carries a group of cathode segments 41 through 47. These cathode segments are preferably arranged to form the numeral "8" and thus define an upper space 71 and a lower space 72 representing the upper and lower "circles" that form the numeral "8". More particularly, segments 41, 45, 46, and 47 define an upper perimeter substantially enclosing space 71, and segments 42, 43, 44, and 45 define a lower perimeter substantially enclosing space 72. As is well known in the art, recognizable indicia (such as any one of the ten digits from zero to nine) can be formed upon appropriate selection of various ones of segments 41 through 47. For example, if segments 47, 46, 45, 42, and 43 are selected, the digit "2" will be formed.

The top surface of base plate 12 also carries a plurality of electrical paths 61 through 67 which are electrically interconnected with corresponding segments 41 through 47 at display position 31. Paths 61 through 67 may also be interconnected with the same corresponding cathode segments at the other display positions 32 through 37 shown in FIG. 1. Electrical paths 61 through 67 are also secured to appropriate ones of cathode terminals 25. Thus, as is well known in the art, the application of an appropriate electrical potential to appropriate ones of cathode leads 24 will cause that potential to be applied to selected ones of cathode segments 41 through 47.

Cathode segments 41 through 47 and electrical paths 61 through 67 can be formed on the top surface of base plate 12 by conventional printing techniques, or by any other method which is well known in the art. Further, to prevent conductive paths 61 through 67 from interfering with the light emanating from selected ones of cathodes 41 through 47 during operation of the gaseous display panel 10, a non-conductive mask 68 is preferably applied across the top surface of base plate 12, except in those areas thereof carrying cathode segments 41 through 47.

Figure 3:
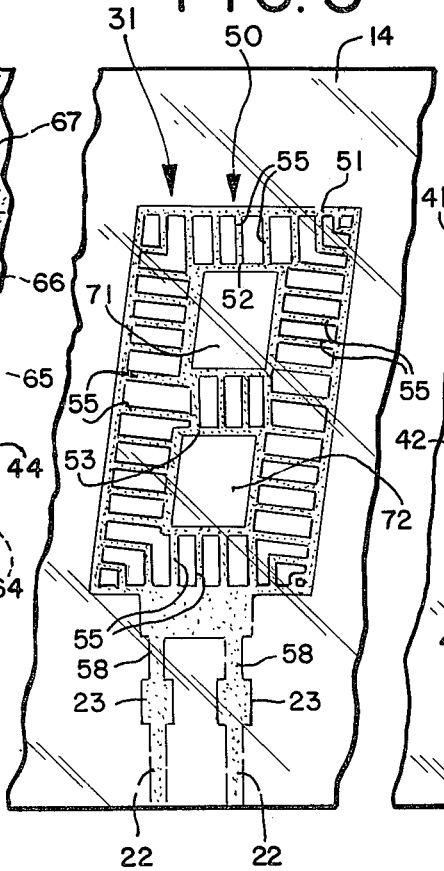
FIG. 3 illustrates a portion of the face plate of the gaseous display panel shown in FIG. 1.

Referring now to FIG. 3, there is illustrated a portion of face plate 14 encompassing display position 31, i.e., the same display position shown for the base plate 12 in FIG. 2. In this preferred embodiment, an anode 50 in the form of an electrically conductive film is printed on the bottom surface of face plate 14. As shown in FIG. 3, anode 50 is electrically connected to anode terminal 23 via an electrical conductor 58.

Anode 50, which may be of nickel, or any other suitable material known in the art, is preferably of an outline similar to but somewhat larger than the outline defined by the peripheral ones of cathode segments 41 through 47 shown in FIG. 2. More particularly, anode 50 includes a length of electrically conductive material which, when placed in overlying position relative to cathode segments 41 through 47, would form an outer loop 51 substantially circumscribing the same. Anode 50 further includes a second length of conductive material in the form of an inner loop 52 which, when placed in overlying relation relative to cathode segments 41 through 47, would fall within the space 71 defined by segments 41, 45, 46, and 47. The anode 50 may further include another length of material in the form of an inner loop 53 similar to the loop 52. When the loop 53 is placed in overlying relation relative to cathode segments 41 through 47 it would fall within the space 72 defined by cathode segments 42, 43, 44, and 45. Thus, when base plate 12 and face plate 14 are secured together, outer loop 51 is spaced on one side of the peripheral ones of segments 41 through 47, and inner loops 52, 53 are spaced on the opposite side of those segments. It should be understood that outer loop 51 can be made of any desired width, and can thus serve as the reinforcing strips used in prior art display panels described hereinbefore.

Figure 4:
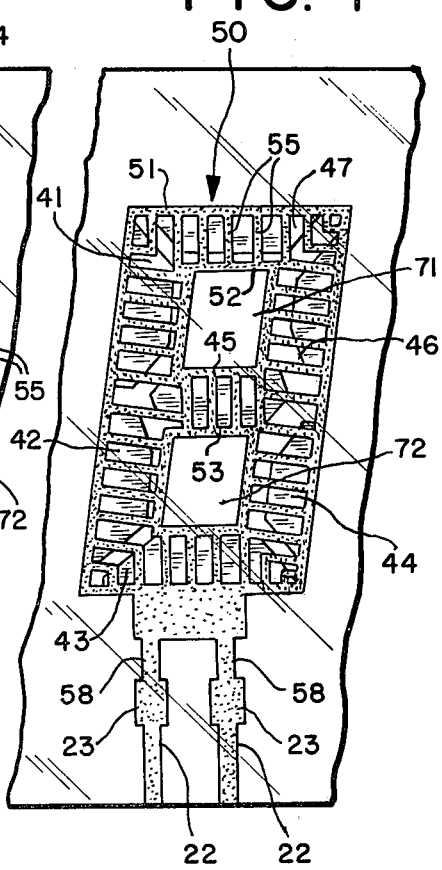
FIG. 4 illustrates the face plate of FIG. 3 superimposed onto the base plate of FIG. 2.

Anode 50 also includes a plurality of web portions 55, at least some of which interconnect outer loop 51 with inner loops 52 or 53. Though the width and spacing of web portions 55 may vary, a width of about 0.002 to 0.003 inches and a spacing of about 0.020 inches to 0.035 inches is believed to be desirable. Further, it is preferred that at least some of the web portions 55 extend substantially orthoganally across at least some of the cathode segments 41 through 47 when face plate 14 is hermetically sealed to base plate 12 as shown in FIG. 4. Thus, in this embodiment, where cathode segments 44 and 46 are oriented at a 10° angle from the vertical, it is desirable that at least some of the web portions 55 extending across cathode segments 44 and 46 be oriented 10° from the horizontal so that they cross those cathode segments perpendicularly. This insures that at least some of the web portions 55 will traverse some of the cathode segments 41 through 47 with a minimal overlap, thereby minimizing light loss due to the obstructing web portion.

The operation of a gaseous display panel such as display panel 10 is well known. Electrical potentials are selectively applied to various cathode segments 41 through 47 at a particular display position such as position 31 by electrical logic circuits (not shown). As explained above, this potential is applied through appropriate cathode leads 24, cathode terminals 25, and conducting paths 61 through 67. Similarly, an opposite potential is appropriately applied to the anode 50 via anode leads 22, anode terminals 23, and conductor 58. Because web portions 55 extend across corresponding ones of cathode segments 41 through 47, ionization of the gas inside display panel 10 occurs, and the selected ones of cathode segments 41 through 47 begin to glow.

Those skilled in the art will appreciate that any scratch or manufacturing defect extending across any of web portions 55 would have only a minimal effect in the glowing of the selected cathode segments, such effect in all likelihood being undetectable by the human eye. This is due to the fact that any "open circuit" resulting from such scratch or defect in the web portion 55 will not prevent the application of anode potential along any other portion of the web portion 55. Indeed, since such anode potential can be applied to web portion 55 from two directions, i.e., from either the circumscribing outer loop 51 or from the interior loops 52, 53, the only part of web portion 55 which will not be at the anode potential is the part where the scratch or defect actually appears.

The web portions 55 can be printed onto the top surface of face plate 14 simultaneously with the outlining outer loop 51 and inner loops 52 and 53 by conventional techniques, and at very little cost. There is thus no need to use the relatively expensive tin oxide anode coatings that have been used heretofore. This results in a substantial savings in manufacturing costs, and the elimination of a significant step in the manufacturing process.

What has been described is a novel gaseous display panel with a webbed anode. Though numerous modifications to the embodiment disclosed herein will be apparent to a person skilled in the art, all such modifications and their equivalents are intended to be covered by the appended claims.

I claim:

1. A gaseous display panel comprising:

a base plate sealed to a face plate;

a plurality of groups of cathode segments disposed on said base plate, each of said groups being displaced from one another, and being adapted to form any of a plurality of recognizable indicia; and a plurality of anode means disposed on said face plate, each in facing relation to a corresponding one of said groups of cathode segments; each of said anode means having a first length of electrically conductive material located, at least in part, a spaced distance from one side of at least one of said segments, a second length of electrically conductive material located, at least in part, a spaced distance from an opposite side of said one of said segments, and a plurality of electrically conductive web portions extending across said one of said segments, and interconnecting said first length and said second length.

2. A gaseous display panel comprising:

a base plate sealed to a face plate;

a plurality of groups of cathode segments disposed on said base plate, each of said groups being displaced from one another, and being adapted to form any of a plurality of recognizable indicia; and a plurality of anode means disposed on said face plate, each in facing relation to a corresponding one of said groups of cathode segments; each of said anode means having two lengths of electrically-conductive material, extending along opposite sides of at least one of said cathode segments a plurality of electrically conductive web portions inter connecting said lengths of electrically conductive material and extending across at least one of said cathode segments in a direction that is substantially orthogonal to the direction defined by the longest dimension of said segment.

3. A gaseous display panel comprising:

a base plate sealed to a face plate;

a group of cathode segments disposed on said base plate, defining an upper perimeter and a lower perimeter which form the numeral "8"; and anode means, disposed on said face plate in facing relation to said group of cathode segments; said anode means having a first loop of electrically conductive material within the space defined by said upper perimeter, a second loop of electrically conductive material within the space defined by said lower perimeter, a third loop of electrically conductive material circumscribing said group of cathode segments, and electrically conductive web portions, some of said web portions extending across at least some of said cathode segments interconnecting said first loop and said third loop, and some other of said web portions extending across at least some other of said cathode segments interconnecting said second loop and said third loop.

4. A gaseous display panel comprising:

a base plate sealed to a face plate;

a plurality of groups of cathode elements disposed on the upper surface of said base plate, each of said groups being displaced from one another, and being adapted to form any of a plurality of recognizable indicia; and a plurality of anode means disposed on the lower surface of said face plate, each in facing relation to a corresponding one of said groups of cathode segments; each of said anode means having two lengths of electrically conductive material extending along opposing sides of each of said cathode segments, a plurality of electrically conductive web portions interconnecting said lengths of electrically conductive material, at least one of said web portions extending across each of said cathode segments.

5. The gaseous display panel defined in claim 4 wherein a plurality of web portions extends across each of said cathode segments.

* * * * *

UNITED STATES PATENT AND TRADEMARK OFFICE

CERTIFICATE OF CORRECTION

PATENT NO. : 4,446,400

DATED : May 1, 1984

INVENTOR(S) : Walter L. Cherry

It is certified that error appears in the above-identified patent and that said Letters Patent is hereby corrected as shown below:

In the specification, column 1, line 53, delete "segmenets" and insert therefor --segments--.

Column 3, line 47, delete "strips" and insert therefor --stripe--.

In the claims, claim 2, line 11, delete the "," after "material".

Claim 2, line 12, after "segments" insert --,--.

Claim 2, line 13, delete "inter connecting" and insert therefor --interconnecting--.

Signed and Sealed this

*Twenty-fifth* Day of *March 1986*

[SEAL]

*Attest:*

DONALD J. QUIGG

*Attesting Officer*

*Commissioner of Patents and Trademarks*